US006625947B1

(12) United States Patent
Burgett

(10) Patent No.: US 6,625,947 B1
(45) Date of Patent: Sep. 30, 2003

(54) INSULATED CONCRETE WALL SYSTEM AND METHOD OF MAKING SAME

(76) Inventor: Ferrall Burgett, 669 Hwy. 28, Norwalk, IA (US) 50211

( * ) Notice: Subject to any disclaimer, the term of this patent is extended or adjusted under 35 U.S.C. 154(b) by 40 days.

(21) Appl. No.: 10/002,828

(22) Filed: Nov. 30, 2001

(51) Int. Cl.[7] ..... E04B 2/00

(52) U.S. Cl. ..... 52/424; 52/127.2; 52/431; 52/565; 52/699

(58) Field of Search ..... 52/424, 127.2, 52/426, 431, 309.12, 562, 565, 699, 713, 715

(56) References Cited

U.S. PATENT DOCUMENTS

| | | | | | |
|---|---|---|---|---|---|
| 4,750,308 | A | * | 6/1988 | McKay | 24/DIG. 32 |
| 4,889,310 | A | * | 12/1989 | Boeshart | 249/134 |
| 4,924,641 | A | * | 5/1990 | Gibbar, Jr. | 52/204.1 |
| 5,040,344 | A | * | 8/1991 | Durand | 52/127.2 |
| 5,337,530 | A | * | 8/1994 | Beames | 52/426 |
| 5,390,459 | A | | 2/1995 | Mensen | |
| 5,570,552 | A | * | 11/1996 | Nehring | 249/91 |
| 5,611,183 | A | * | 3/1997 | Kim | 52/357 |
| 5,649,401 | A | | 7/1997 | Harrington, Jr. | |
| 5,692,356 | A | * | 12/1997 | Baxter | 249/213 |
| 5,809,728 | A | * | 9/1998 | Tremelling | 52/426 |
| 5,845,445 | A | * | 12/1998 | Blackbeard | 52/426 |
| 5,852,907 | A | | 12/1998 | Tobin et al. | |
| 5,987,830 | A | * | 11/1999 | Worley | 249/190 |
| 5,992,114 | A | * | 11/1999 | Zelinsky et al. | 249/216 |
| 6,178,711 | B1 | * | 1/2001 | Laird et al. | 52/357 |
| 6,240,692 | B1 | | 6/2001 | Yost et al. | |
| 6,250,033 | B1 | * | 6/2001 | Zelinsky | 52/268 |
| 6,293,067 | B1 | * | 9/2001 | Meendering | 52/426 |
| 6,349,520 | B2 | * | 2/2002 | Kubica | 52/425 |

OTHER PUBLICATIONS

Print out of web site for www.richwalls.com, 10 pages.

* cited by examiner

*Primary Examiner*—Carl D. Friedman
*Assistant Examiner*—Steve Varner
(74) *Attorney, Agent, or Firm*—McKee, Voorhees & Sease, P.L.C.

(57) ABSTRACT

A method and system for installing an insulated concrete wall includes insulation panels placed in an upright manner. Generally T-shaped wall studs are placed next to the insulation panels such that the front section of the wall stud is on the outside of the insulation panels and an anchoring section of the wall stud extends beyond the insulation panels into the gap into which concrete will later be poured. Concrete pouring forms are placed so as to render the gap into which concrete will be poured a desired thickness. The wall stud may also include slots for receiving cross-ties that secure the concrete pouring forms in proper position and retaining nubs that prevent the insulation panels from floating when concrete is poured. Concrete is then poured into the gap, surrounding the anchoring section the T-shaped wall stud.

9 Claims, 5 Drawing Sheets

INSULATED CONCRETE WALL SYSTEM AND METHOD OF MAKING SAME

BACKGROUND OF THE INVENTION

1. Field of the Invention

The present invention relates generally to a method and system for forming insulated concrete walls. More particularly, though not exclusively, the present invention relates to a method and system for securing insulation panels to a poured concrete basement wall while still providing a visible wall stud that may be used for finishing and other purposes such as hanging drywall.

2. Background of the Invention

Rising utility costs have increased the demand for concrete walls, such as those in most basements, that are insulated. Basement walls made from insulated concrete blocks, with the insulation actually contained in the concrete blocks, are extremely expensive and time consuming to install. Poured concrete walls are much less costly and take less time to install. Insulation has typically then been added or fastened to one or both faces of the concrete. Adding insulation after a concrete wall has hardened is an expensive and time consuming process.

Conventional uninsulated reinforced concrete walls are poured into forms that are typically constructed of heavy plywood panels clamped and nailed into place with cross-ties between parallel panels to prevent them from spreading apart under the hydraulic forces generated by the concrete. The plywood is initially treated so it can be stripped away after the concrete is set.

It has been shown that rigid foam plastic panels are strong enough to substitute for plywood, thus providing an insulated wall. For example, in U.S. Pat. No. 6,240,692 issued Jun. 5, 2001 to Yost, a series of rigid foam panels are used in place of the plywood forms. The foam panels of Yost are left in place permanently, thus providing the poured concrete wall with insulation on both sides. Yost also discloses a plurality of wall studs encased in each panel, each stud having a trust structure for increased strength.

Similarly, a pair of insulative panels are used in place of the plywood forms in U.S. Pat. No. 5,040,344 issued Aug. 20, 1991 to Durand. Durand discloses reinforcing each of the panels with horizontal stiffeners and using removable shores to maintain the panels in a vertical position during concrete pouring.

All of these systems require specialty components that are time consuming to install and drastically increase the costs of insulating poured concrete walls. Further, many of these systems also have their studs embedded in the foam. Embedding the studs in the foam requires the foam be specially made to fit the studs. This prevents the builder of the concrete wall from selecting the thickness of insulation to be used on site. This also makes it difficult to find the studs if additional finishing of the walls is to be done. There is therefore a need for an insulation system that is quick and easy to install, variable, relatively inexpensive, and that has wall studs visible beyond the insulation panels.

Because many of these insulation systems also use foam panels in place of plywood or aluminum forms, the insulation panels must be on both sides of the concrete wall. Often, insulation is only desired on the inside portion of the concrete walls. There is therefore a need for an insulation system that may be used only where and when desired.

It is therefore a primary feature of the present invention to overcome the problems in the prior art.

It is a further feature of the present invention to provide an insulated concrete wall system that is relatively low cost and easy to use.

Another feature of the present invention is to provide an insulated concrete wall system that allows insulation panels to be placed on one or both sides of a poured concrete wall.

A still further feature of the present invention is the provision of an insulated concrete wall system in which wall studs are secured in the poured concrete wall upon hardening of the concrete.

Another feature of the present invention is the provision of an insulated concrete wall system in which the wall studs are visible for easy finishing of the wall.

A still further feature of the present invention is the provision of an insulated concrete wall system in which the wall studs retain the foam panels to prevent them from floating during concrete pouring.

These, as well as other features, objects, and advantages of the present invention, will become apparent from the following specification and claims.

BRIEF SUMMARY OF THE INVENTION

The present invention generally comprises an insulated concrete wall system and method for installing same. The system of the present invention includes insulation panels, walls studs and forms placed so as to form a channel into which concrete will be poured. Insulation panels and forms are well known in the art and commercially available. The channel's thickness is designed to correspond to the desired thickness of the wall.

The generally T-shaped wall studs are placed adjacent to one end of an insulation panel before the next insulation panel is put in place. The front section of the T-shaped wall stud extends beyond the front surface of the insulation panels and will be visible on the completed wall. The anchor section of the T-shaped wall studs extends beyond the width of the insulation panels and into the channel itself.

The thickness of the channel is maintained by the use of cross-ties. Preferably, these cross-ties go through slots in the T-shaped wall studs. The wall studs also preferably include several retaining nubs which prevent the insulation panels from floating or otherwise moving during concrete pouring. At the corner of a wall, a corner bracket may be used to secure two insulation panels in proper position. The corner bracket includes two channels for receiving insulation panels. The ends of these channels may include a retaining portion to secure the insulation panels in place.

When concrete is poured to fill the channel, the concrete surrounds the anchor section of the T-shaped wall stud. Upon hardening, the concrete secures the T-shaped wall stud in place. Aluminum or wooden forms are used to support the insulation panels and T-shaped wall studs during concrete pouring and are removed after the concrete has hardened.

DETAILED DESCRIPTION OF THE INVENTION

The present invention will be described as it applies to its preferred embodiment. It is not intended that the present invention be limited to the described embodiment. It is intended that the invention cover all modifications and alternatives which may be included within the spirit and scope of the invention.

Figure 1:
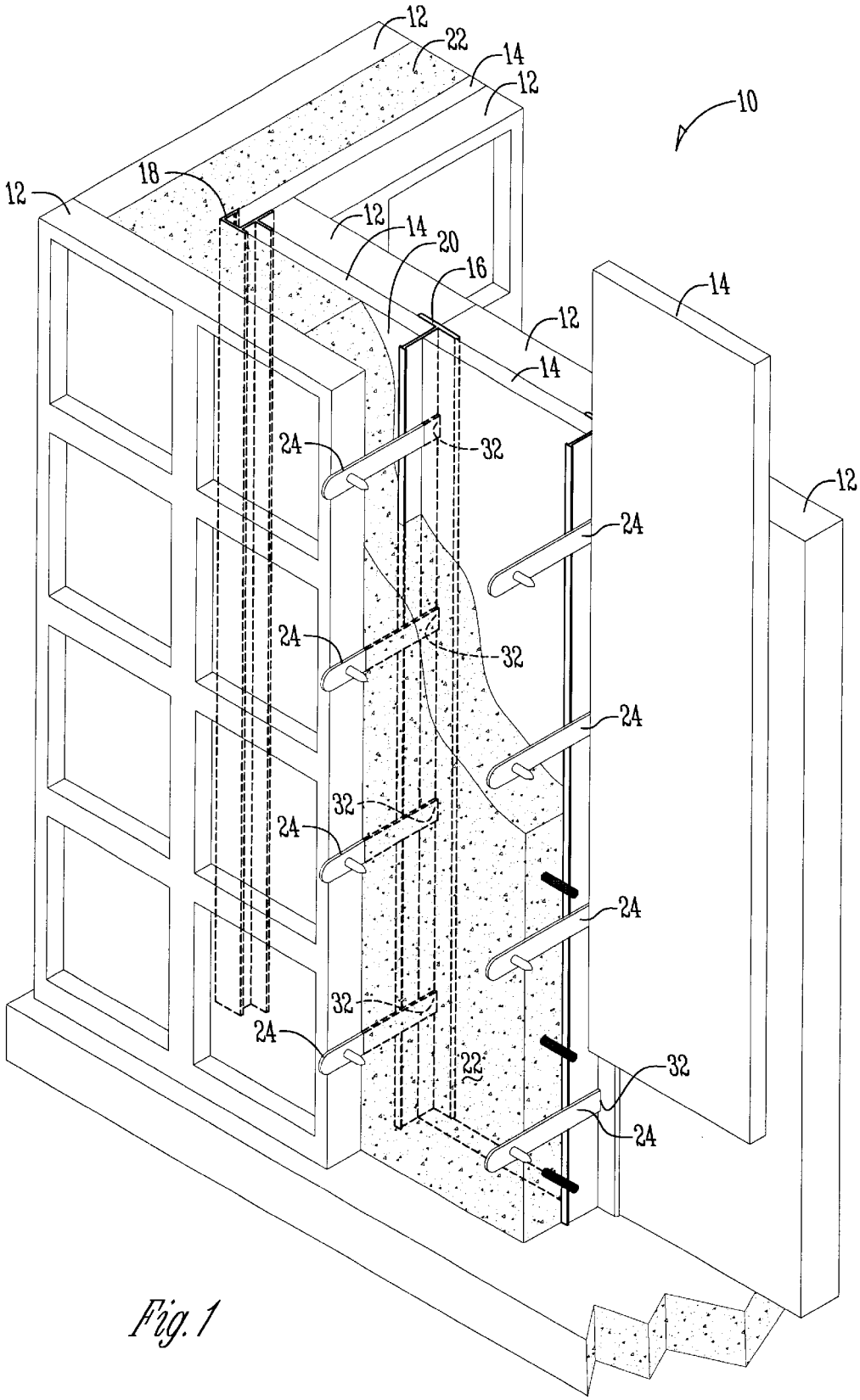
FIG. 1 is a perspective view of the insulated concrete wall system of the present invention as assembled.

Now, referring to the drawings, FIG. 1 illustrates the insulated concrete wall system 10 of the present invention. The insulated concrete wall system 10 generally includes a number of forms 12 and insulation panels 14 secured to the concrete wall by a plurality of wall studs 16. The forms are well known in the art and made of wood, aluminum or other suitable materials.

Initially, insulation panels 14, are placed upright along the edge of what is to be the concrete wall 22. Each insulation panel or sheet of insulation material has a front surface, rear surface, top side, bottom side, first edge, and second edge. A T-shaped wall stud 16 is placed along either the first or second edge of the insulation panel 14. Next, another insulation panel 14 is placed on the other side of the T-shaped wall studs 16. This process is continued until one side of the wall is formed.

As is also shown in FIG. 1, the builder places forms 12 across from the sheets of insulation 14 to form a channel 20 into which concrete 22 is poured. The width of the channel 20 is designed to correspond to the desired width of the concrete wall 22. Typically, building codes require concrete walls to be at least 8 inches thick. Additional forms 12 may be placed on the outside of the insulation panels 14 and wall stud 16 to provide support necessary to prevent the insulation panels 14 and wall studs 16 from moving when concrete 22 is poured.

Figure 5:
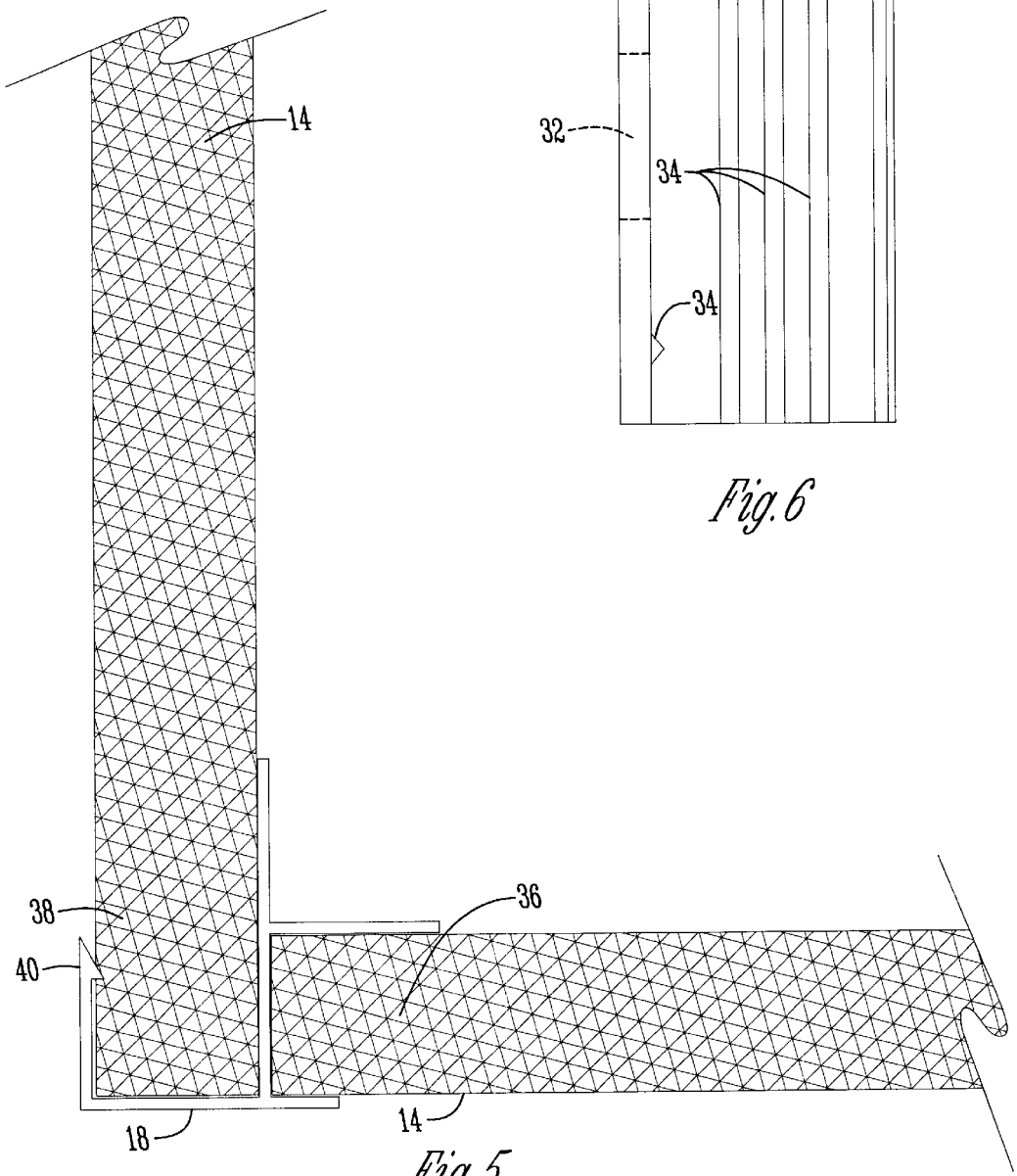
FIG. 5 is a top view of the corner bracket, as installed, of the present invention.

When needed, corner brackets 18 may be used to secure two insulation panels 14 at right angles to one another. As is more clearly shown in FIG. 5, the corner bracket 18 includes a first channel 36 and a second channel 38 into which insulation panels 14 may be secured. Preferrably, the corner bracket 18 may also include a retaining portion 40 to keep the insulation panels 14 in place.

Figure 3:
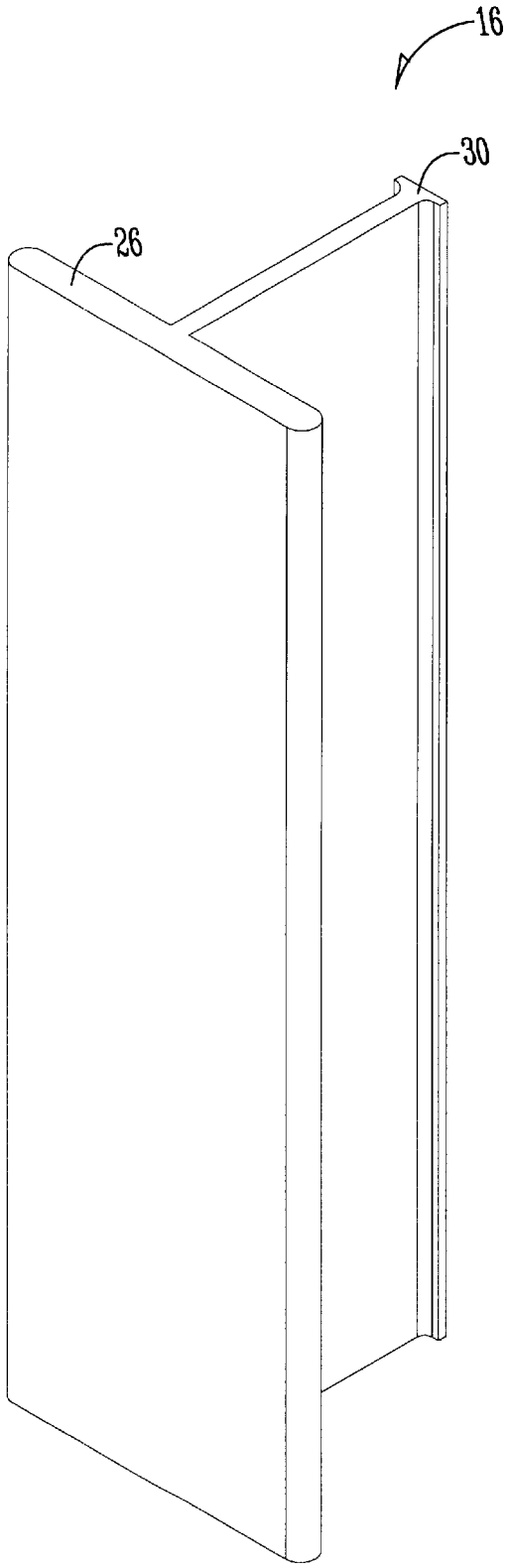
FIG. 3 is one example of the T-shaped wall stud of the present invention.

As is shown in FIG. 3, the T-shaped wall studs 16 of the present invention generally include a front section 26 that is connected to an anchoring section 28. The retaining portion 30 at the end of the anchor section 28 is also included. The retaining section 30 prevents the T-shaped wall stud 16 from being easily removed from the concrete wall 22. Preferably, the T-shaped wall stud 16 is made by extruding a resilient plastic material. This helps to keep costs down and allows the wall stud 16 to be made to any desired length.

Figure 4:
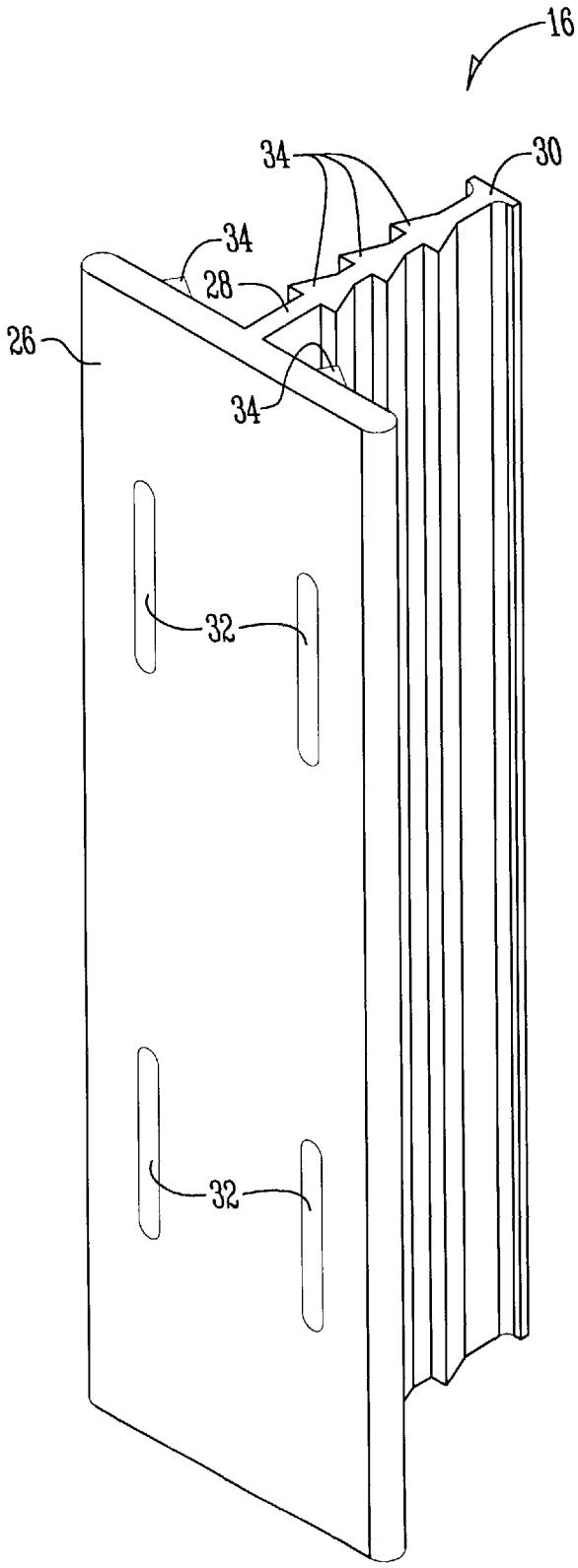
FIG. 4 is a second example of the T-shaped wall stud of the present invention.

Alternatively, the wall stud 16 may also include nubs 34 and slots 32 as is shown in FIG. 4. The slots 32 are designed to accommodate the cross-ties 34 that may be inserted through the T-shaped wall studs 16 during installation as is shown in FIG. 1. Preferrably, the slots 32 are spaced vertically along one side of the front section 26. The number and spacing of the slots 32 can vary depending on the user's preference. Using cross-ties 34 ensures the concrete wall 22 will be of uniform thickness.

Figure 2:
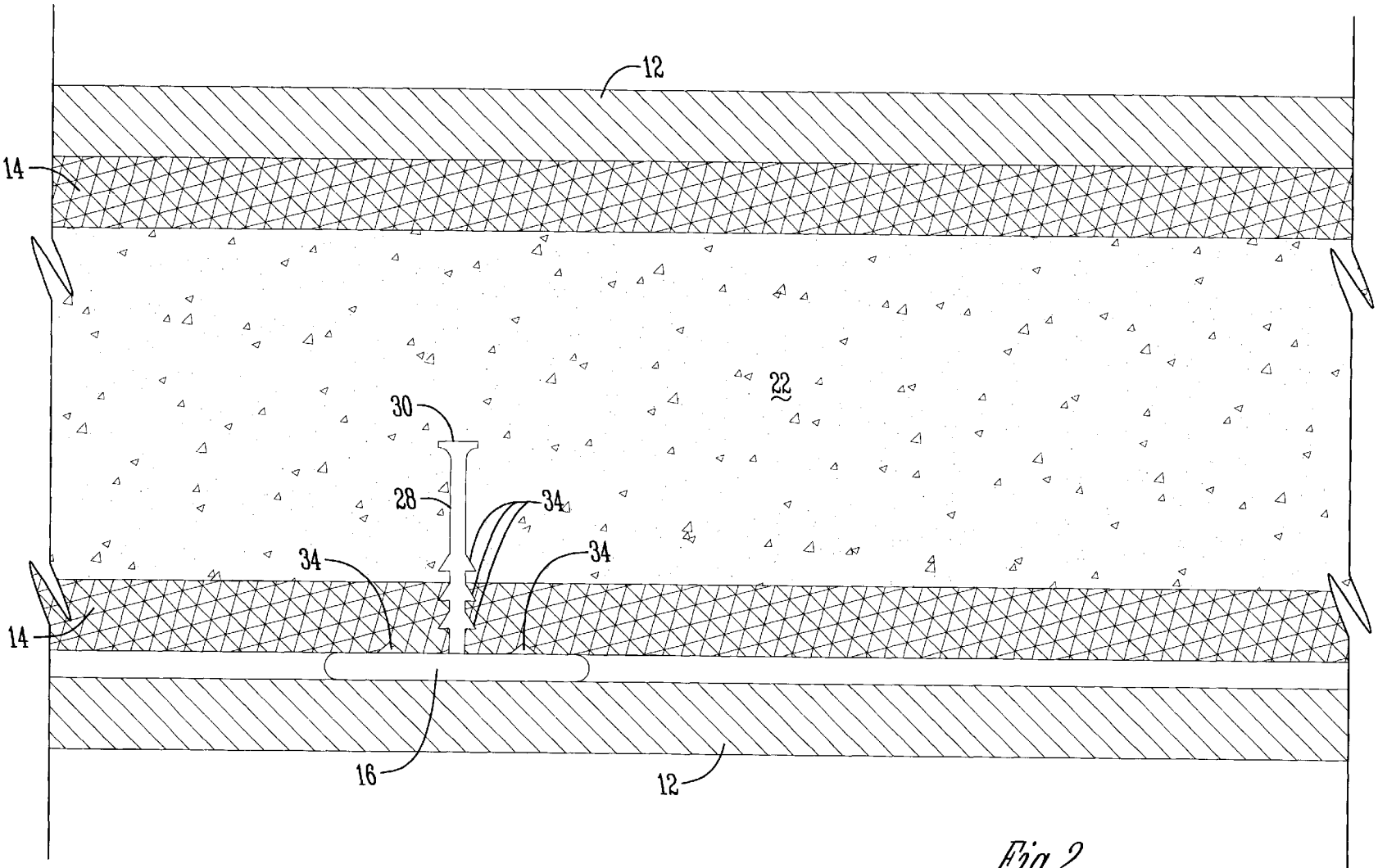
FIG. 2 is a top view of one embodiment of the insulated concrete wall system of the present invention.
Figure 6:
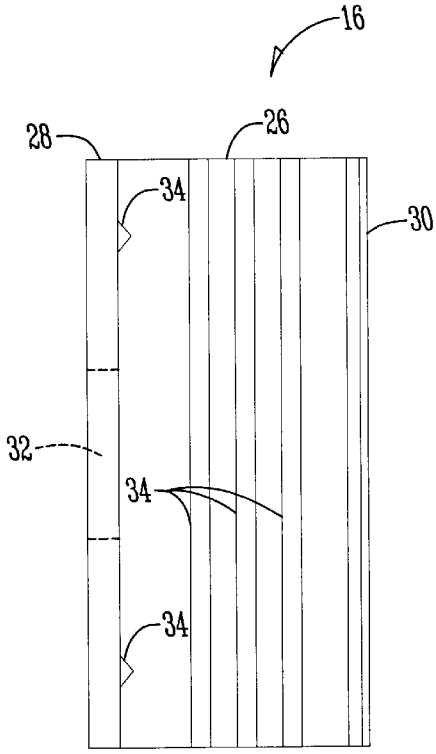
FIG. 6 is a side view of the embodiment of the T-shaped wall stud shown in FIG. 4.

As is shown in FIGS. 2 and 6, the nubs 34 are designed to prevent the insulation panels 14 from upward movement when the concrete 22 is poured into the gap 20. Preferrably, the nubs 34 are located on the anchor section 28. The nubs 34 may be of any desired shape and be located on either or both the front section 26 or the anchor section 28 of the wall stud 16.

As can also be seen in FIG. 2, a portion of the anchor section 28 of the wall stud 16 is secured within the concrete 22 of the wall. The desired width of the insulation panels 14 may be changed by the builder at any time. The anchor section 28 of the wall stud 16 is of a length that allows for many different thicknesses of insulation panels 14 to be used. For example, if four inches of insulation is used instead of two inches, two inches less of the anchoring section 28 will be secured in the concrete 22 of the wall.

Once all of the insulation panels 14, wall studs 16, forms 12 and other materials are in proper position, concrete 22 is poured into the gap 20. After the concrete 22 has hardened or set, the forms 12 are removed. This leaves an insulated concrete wall wherein the wall studs 16 are clearly visible. Additionally, because the wall studs 16 are on the outside of the insulation panels 14, drywall may be easily secured to the wall studs 16. Therefore, finishing a wall insulated according to the system of the present invention is expedited. Further, because the wall studs 16 are on the outside of the insulation panels 14, a small gap will exist between any installed drywall and the insulation panels 14. This increases the R-value of the wall constructed according to the system 10 of the present invention. Higher R-values are desirable as homes constructed with high R-value walls have lower overall heating and cooling costs.

Further, because the wall studs 16 are on the outside of the insulation panels 14, no special connection between the insulation panels 14 and wall studs 16 is required. This allows the builder to purchase any type of insulation panel 14 from any vendor at the lowest possible costs.

A general description of the present invention as well as a preferred embodiment to the present invention has been set forth above. Those skilled in the art to which the present invention pertains will recognize and be able to practice additional variations in the methods and systems described which fall within the teachings of this invention. Accordingly, all such modifications and additions are deemed to be within the scope of the invention which is to be limited only by the claims appended hereto.

What is claimed is:

1. A structure for pouring concrete walls, the structure comprising:

a first sheet of insulation material, the first sheet having a front surface, rear surface, top side, bottom side, first edge, and second edge;

a second sheet of insulation material, the second sheet having a front surface, rear surface, top side, bottom side, first edge, and second edge;

a substantially T-shaped wall stud that is placed along the first edge of the first sheet of insulation and the second edge of the second sheet of insulation, the wall stud having a front section that is placed on top of the front surface of the first sheet and the front surface of the second sheet, an anchoring section extending perpendicularly from the front section, the anchoring section being long enough to extend beyond the rear surface of the first sheet and the rear surface of the second sheet, and a retaining section extending perpendicularly from the anchoring section, the retaining section being free from contact with the first sheet;

a first concrete pouring form placed on top of the front section of the wall stud and the front surface of the first sheet and the front section of the second sheet; and a second concrete pouring form placed behind the rear surface of the first sheet and the rear surface of the second sheet and behind the anchoring section of the wall stud forming a gap between the second concrete pouring form and the rear surface of the first sheet and the rear surface of the second sheet, the width the gap corresponding to the desired thickness of the concrete wall.

2. The structure of claim 1 wherein the substantially T-shaped wall stud includes retaining nubs.

3. The structure of claim 1 wherein the front section of the wall stud includes a slot for receiving a cross-tie.

4. The structure of claim 1 further comprising a corner bracket placed along the second edge of the first sheet.

5. The structure of claim 1 wherein the T-shaped wall stud is a single piece of material.

6. A method of pouring an insulated concrete wall the method comprising:

setting a sheet of insulation material in a desired location, the sheet having a front surface, rear surface, top side, bottom side, first edge, and second edge;

placing a substantially T-shaped wall stud along the first edge of the sheet, the wall stud having a front section that is placed on top of the front section of the first sheet, an anchoring section extending perpendicularly from the front section, the anchoring section terminating in an end and the anchoring section being long enough to extend beyond the rear surface of the first sheet and a retaining section extending perpendicularly from the end of the anchoring section;

placing a first concrete pouring form on top of the front section of the wall stud and the front surface of the first sheet;

placing a second concrete pouring form behind the rear surface of the first sheet and behind the anchoring section of the wall stud forming a gap between the second concrete pouring form and the rear surface of the first sheet, the width of the gap corresponding to the desired thickness of the concrete wall; and pouring concrete into the gap and surrounding the portion of the anchoring section extending beyond the rear surface of the first sheet.

7. The method of pouring an insulated concrete wall of claim 6 further comprising removing the first concrete pouring form and the second concrete pouring form after the concrete has hardened.

8. An insulated concrete wall produced according to the process of claim 6.

9. A substantially T-shaped wall stud for securing insulation panels to a concrete wall, the wall stud comprising:

a front section;

an anchoring section secured perpendicular to the front section, the anchoring section terminating in an end;

a retaining section secured perpendicular to the anchoring section at the end of the anchoring section;

a slot in the front section, the slot designed to receive a cross-tie; and a retaining nub for contacting an insulation panel.

* * * * *